US007874694B2

(12) United States Patent
Li

(10) Patent No.: US 7,874,694 B2
(45) Date of Patent: Jan. 25, 2011

(54) DIGITAL TOOL WITH A LIGHT DISPLAY

(75) Inventor: Ming-Hua Li, Taichung County (TW)

(73) Assignee: Eclat-torQ Technology Co., Ltd., Taichung County (TW)

( * ) Notice: Subject to any disclaimer, the term of this patent is extended or adjusted under 35 U.S.C. 154(b) by 204 days.

(21) Appl. No.: 12/324,683

(22) Filed: Nov. 26, 2008

(65) Prior Publication Data

US 2009/0165608 A1 Jul. 2, 2009

(30) Foreign Application Priority Data

Dec. 28, 2007 (TW) ..... 96222315 U

(51) Int. Cl.
*B25B 23/18* (2006.01)

(52) U.S. Cl. ..... 362/119; 362/109; 362/120; 362/227; 362/249.02; 362/800; 81/177.1; 81/489

(58) Field of Classification Search ..... 362/109, 362/119, 120, 227, 234, 249.01, 249.02, 362/253, 557, 800; 81/177.1, 489
See application file for complete search history.

(56) References Cited

U.S. PATENT DOCUMENTS

2005/0152131 A1* 7/2005 Shirane ..... 362/119
2007/0044983 A1* 3/2007 Wuensch et al. ..... 173/217

* cited by examiner

*Primary Examiner*—Sandra L O Shea
*Assistant Examiner*—Meghan K Dunwiddie
(74) *Attorney, Agent, or Firm*—Banger Shia

(57) ABSTRACT

A digital tool with a light display comprises at least one light display assembly. The light display assembly includes four or more light-emitting elements to cooperate with a light-transmitting element. The light display assembly can be the whole or a part of a handle sleeve. Therefore, by cooperating with a compare unit and a control unit, under the predetermined condition, the light-emitting elements can emit light through the light-emitting area synchronously or alternately.

15 Claims, 11 Drawing Sheets

DIGITAL TOOL WITH A LIGHT DISPLAY

BACKGROUND OF THE INVENTION

1. Field of the Invention

The present invention relates to a digital tool, and more particularly to a digital tool with a light display, which can facilitate the user observing the light from the digital tool.

2. Description of the Prior Art

A common digital torque tool is a tool that itself can be provided to set a predetermined condition or a tool that has been inherently set with the predetermined condition before leaving the factory. When in use, once the operation torque satisfies the predetermined condition, the tool itself will emit a sound signal to warn the user, and meanwhile, the tool will be powered off to stop outputting torque.

However, as for the noisy working environment, the sound signal is frequently ignored or even not heard at all, so that using sound signal to warn the user is not effective, and using optical signal as warning signal will be more useful in various working environments.

Generally speaking, the torque tool can be provided with a pre-hole for exposition of the light-emitting surface of a LED or provided with a small area of pre-reserved transmission surface opposite the light-emitting surface of the LED. By such arrangements, when the operation torque satisfies the predetermined condition, the light from the LED can be seen. In addition, the torque tool can also be provided with two LEDs to utilize the variation of the light colors and the lighting modes of the two LEDs to show if the operation torque has satisfied the predetermined condition. Nevertheless, in such a torque tool, the light-emitting surface is small and the visible area is also small, so that once the user is located at a position opposite the LED to observe the LED, the lighting state of the LED cannot be observed directly.

Another method of arranging a LED is to form a protruding transparent surface on the handle of the tool, so that when the light from the LED light passes through the transparent surface, it will have more visible area and directions, thus facilitating the user observing the variation of the light. However, the protruding transparent surface is possibly damaged since the torque tool is improperly placed or moved or trampled by the user. Therefore, the above structure design is also not ideal.

To apply a bigger or more intensive light source is also a method for improving the viewable rate of the light. However, since the power of the power source is resultantly increased, such a light source has been used for illumination so far.

The present invention has arisen to mitigate and/or obviate the afore-described disadvantages.

SUMMARY OF THE INVENTION

Considering that the sound signal has a poor warning effect during the operation of a general digital tool, and the optical signal has the disadvantages of small light display area, poor directionality, the present invention provides a digital tool which has a light alternation display effect and large light display area.

The primary objective of the present invention is to provide a digital tool with a light display, which can produce an obvious light display effect to remind the user of the present operating state.

In order to achieve the above objective, the digital tool in accordance with the present invention comprises at least one light display assembly. The light display assembly includes four or more light-emitting elements to cooperate with a light-transmitting element. The light display assembly can be the whole or a part of a handle sleeve. Therefore, by cooperating with a compare unit and a control unit, under the predetermined condition, the light-emitting elements can emit light through the light-emitting area synchronously or alternately.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1A:
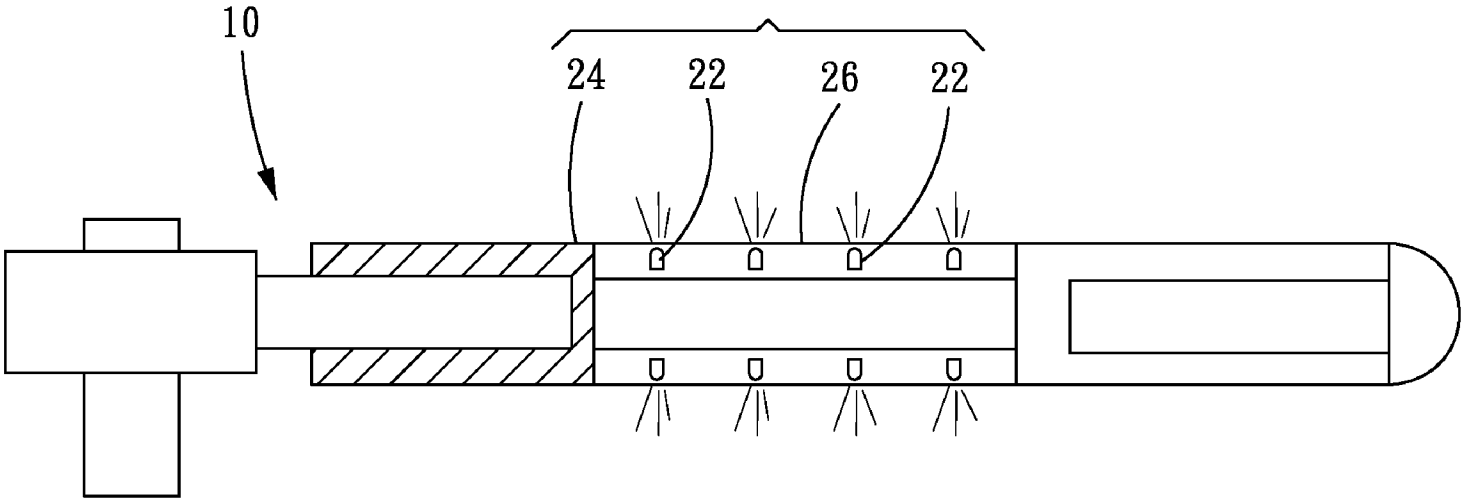
FIG. 1A is a plane view of a digital tool with a light display in accordance with the present invention.

Referring to FIG. 1A, a digital tool with a light display in accordance with the present invention is used to produce an operation force and has a function of setting or being inherently set with a predetermined condition. The digital tool in accordance with the present invention comprises a tool body 10, and a light display assembly 20 assembled on the tool body 10. The light display assembly 20 is provided with four or more light-emitting elements 22, for example, the light-emitting diodes, and each of the light-emitting elements 22 is located opposite a light-transmitting element 24. Further speaking, the light-transmitting element 24 has a light-transmitting area 26 opposite the light-emitting elements 22.

Figure 1B:
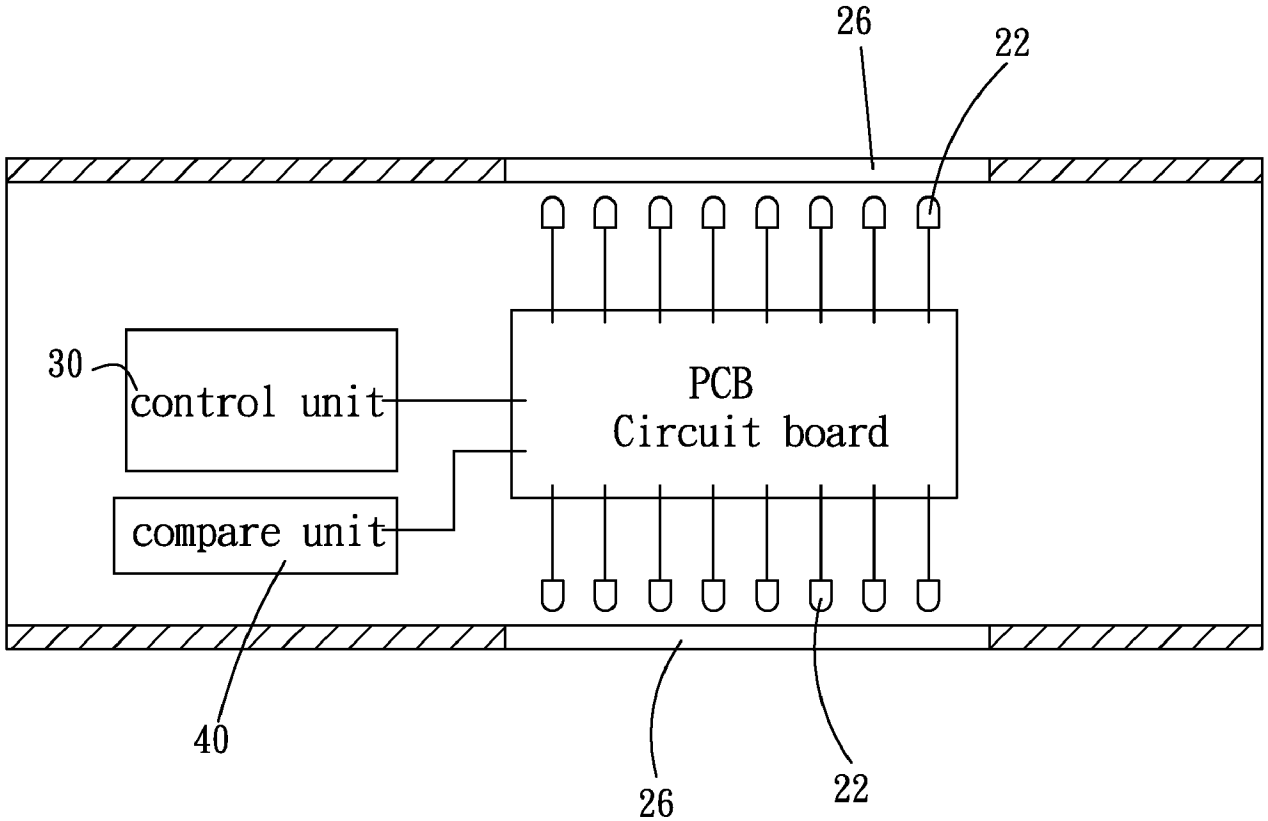
FIG. 1B is a plane view of a light display assembly in accordance with the present invention.

Referring to FIG. 1B, a control unit 30 and a compare unit 40 are both electrically connected to the light-emitting elements 22. The compare unit 40 is used to compare the operation force with the predetermined force, and the control unit 30 is used to control the lighting modes of the respective light-emitting elements 22. Hence, the control unit 30 and the compare unit 40 can cooperate with each other to constitute a display means which can drive the respective light-emitting elements 22 to emit light synchronously or alternately through the light-transmitting areas 26 under the predetermined condition. The above control unit 30 can be a programmable unit.

Figure 2A:
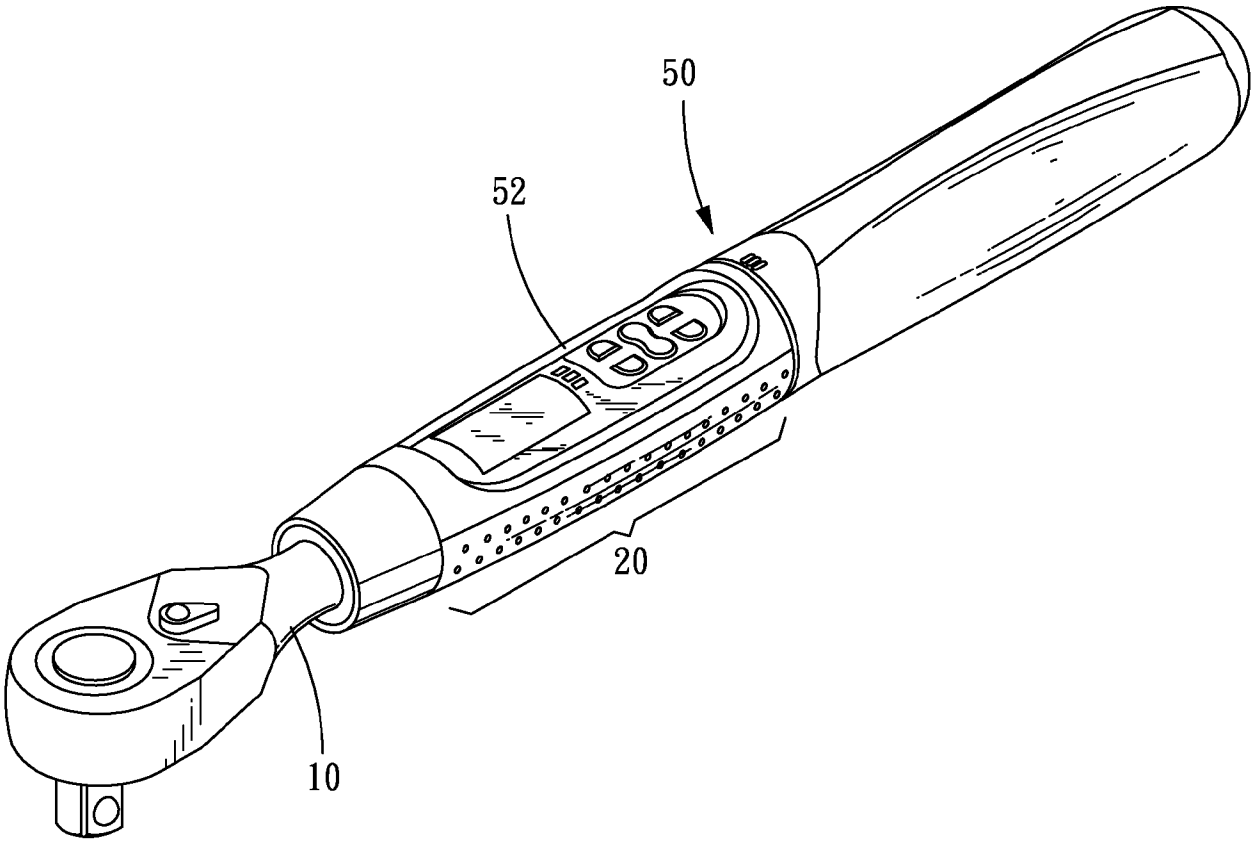
FIG. 2A is a perspective view of the digital tool with a light display in accordance with a first embodiment of the present invention.
Figure 2B:
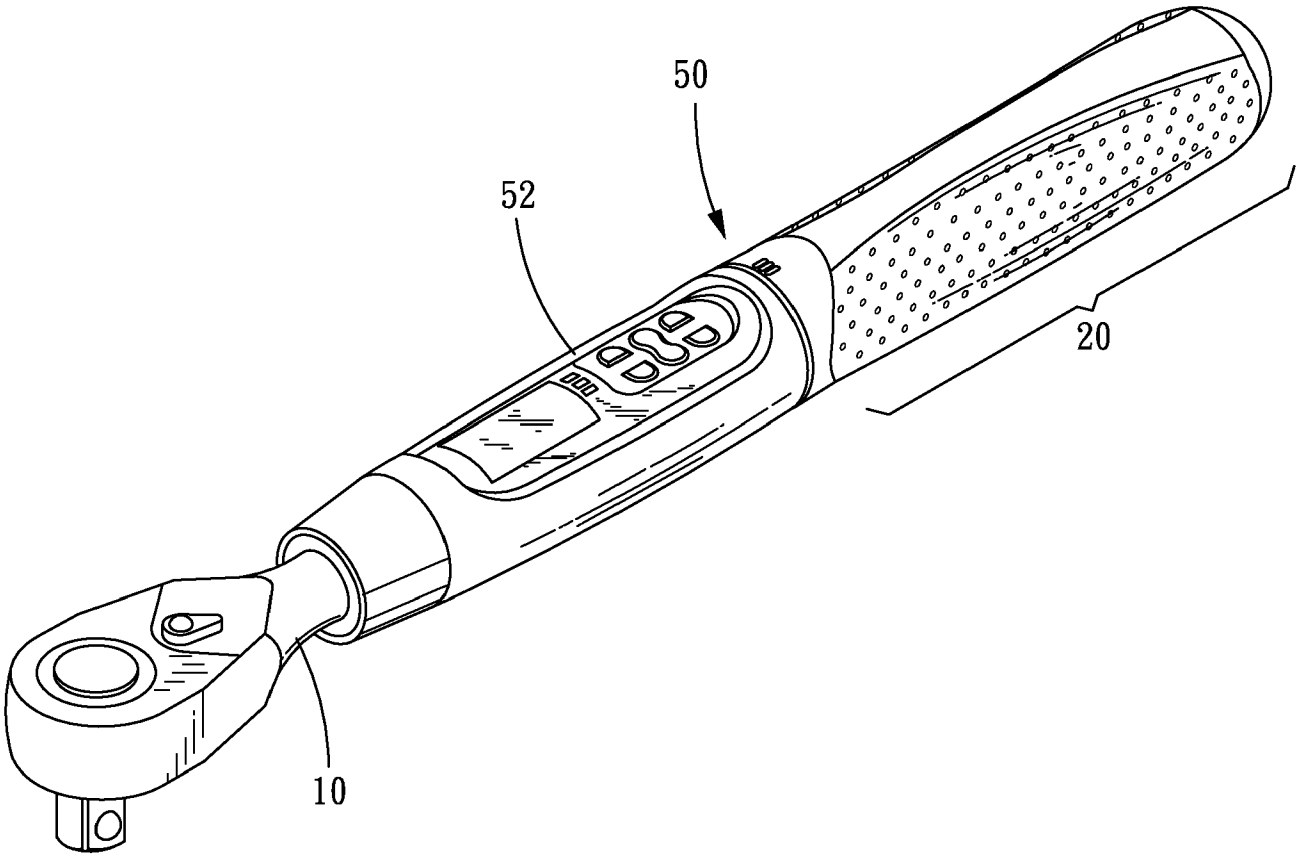
FIG. 2B is a perspective view of the digital tool with a light display in accordance with a second embodiment of the present invention.
Figure 2C:
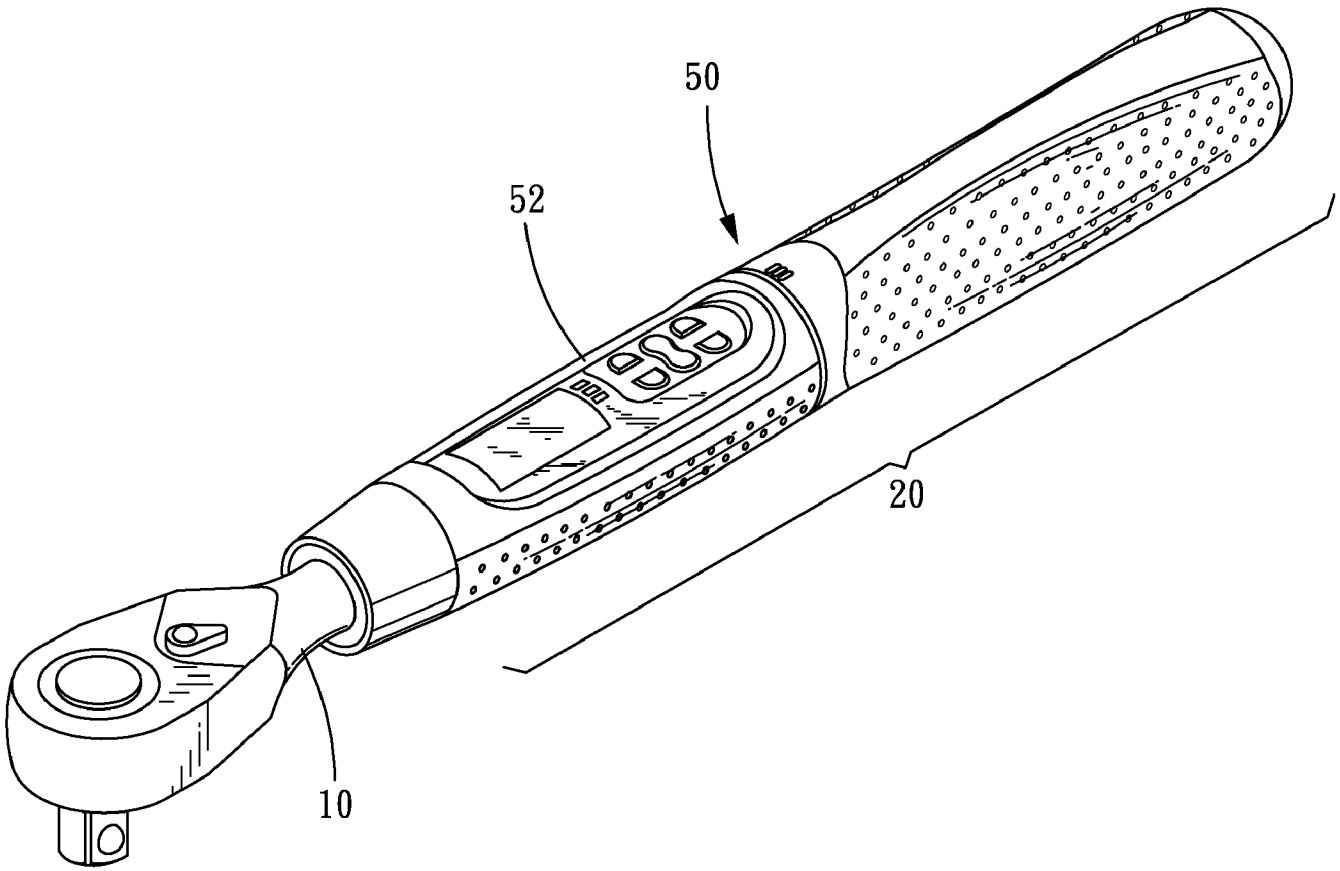
FIG. 2C is a perspective view of the digital tool with a light display in accordance with a third embodiment of the present invention.

Referring to FIGS. 2A-2C, a handle sleeve 50 is assembled on the outer surface of the tool body 10. The light display assembly 20 is herein defined to constitute the whole or a part of the handle sleeve 50. Further speaking, the handle sleeve 50 includes a handle 52, and the light display assembly 20 is the whole or a part of the handle 52.

Figure 3:
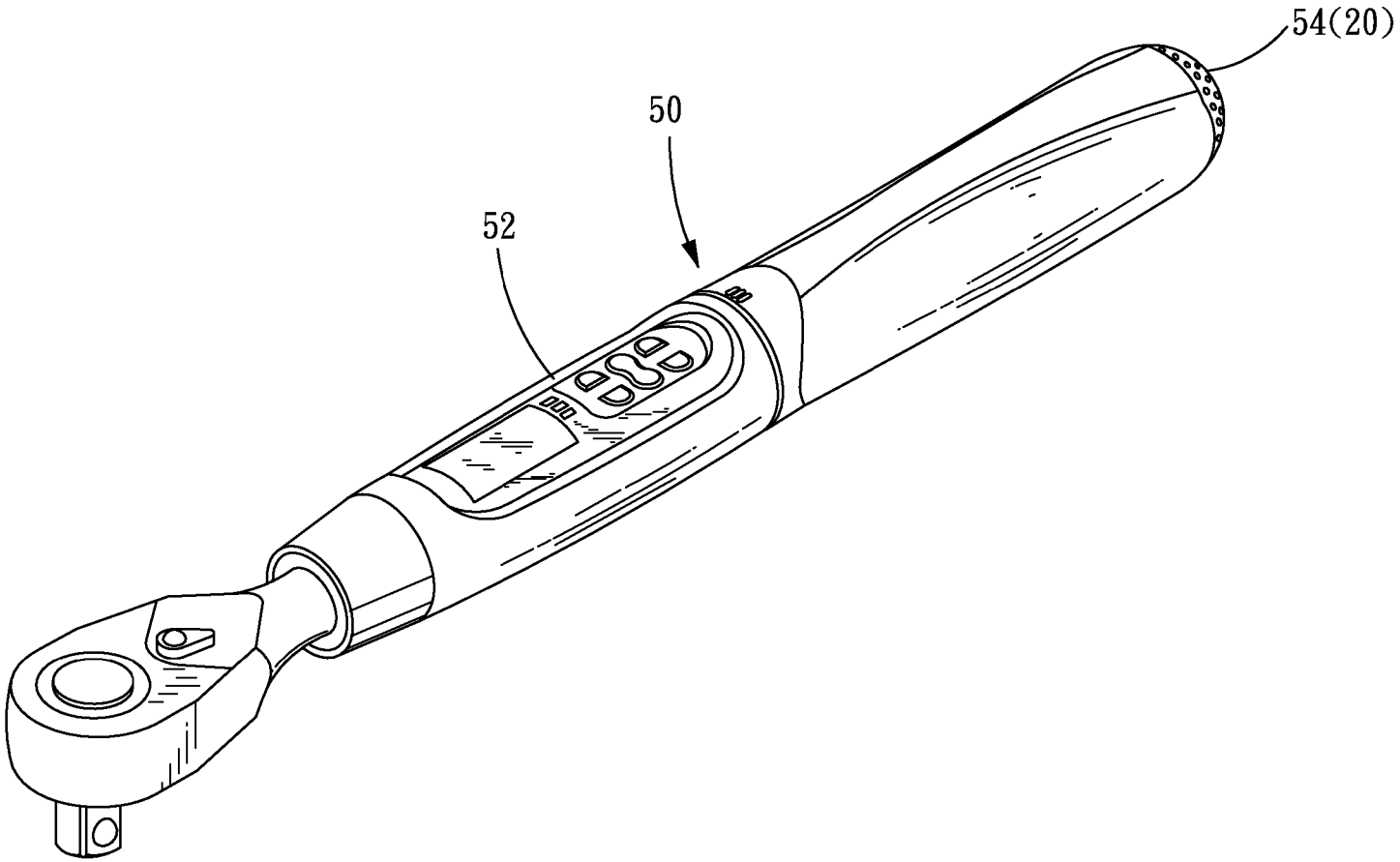
FIG. 3 is a perspective view of the digital tool with a light display in accordance with a fourth embodiment of the present invention.

Referring to FIG. 3, the handle 52 of the handle sleeve 50 includes a battery cover 54. The light display assembly 20 is the battery cover 54.

Figure 4:
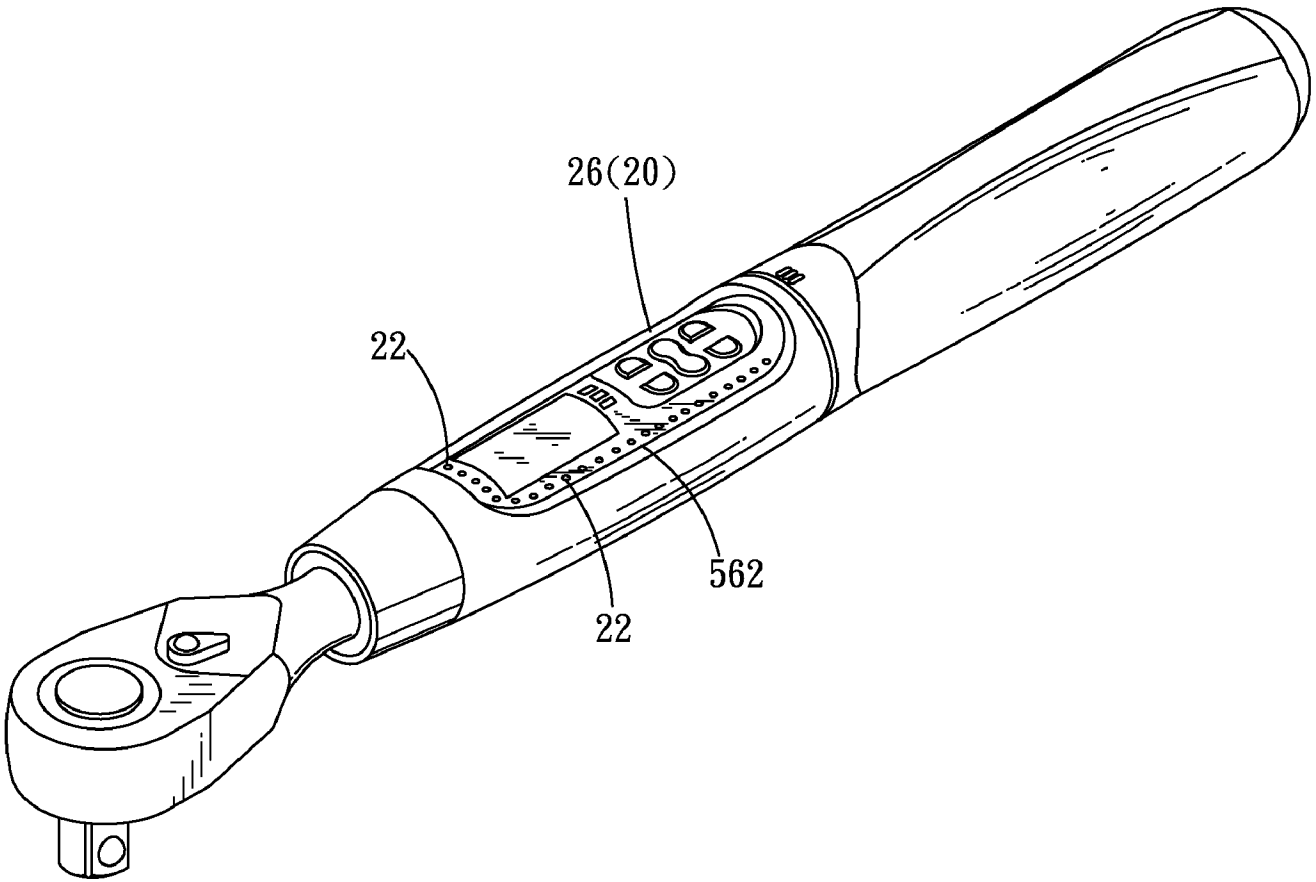
FIG. 4 is a perspective view of the digital tool with a light display in accordance with a fifth embodiment of the present invention.

Referring to FIG. 4, the handle sleeve 50 includes a control case 56. The light display assembly 20 is the whole of part of the control case 56, for example, the light-transmitting element 24 of the light display assembly 20 is the upper cover 562, and the light-emitting elements 22 are located on one side of the upper cover 562.

Figure 5A:
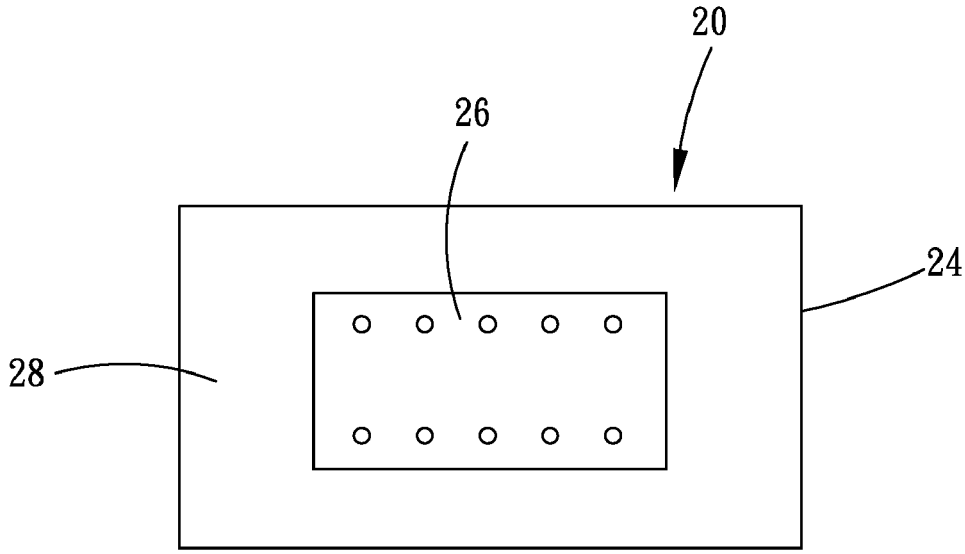
FIG. 5A is a schematic view illustrating a light-transmitting area and its surround area in accordance with the present invention.
Figure 5B:
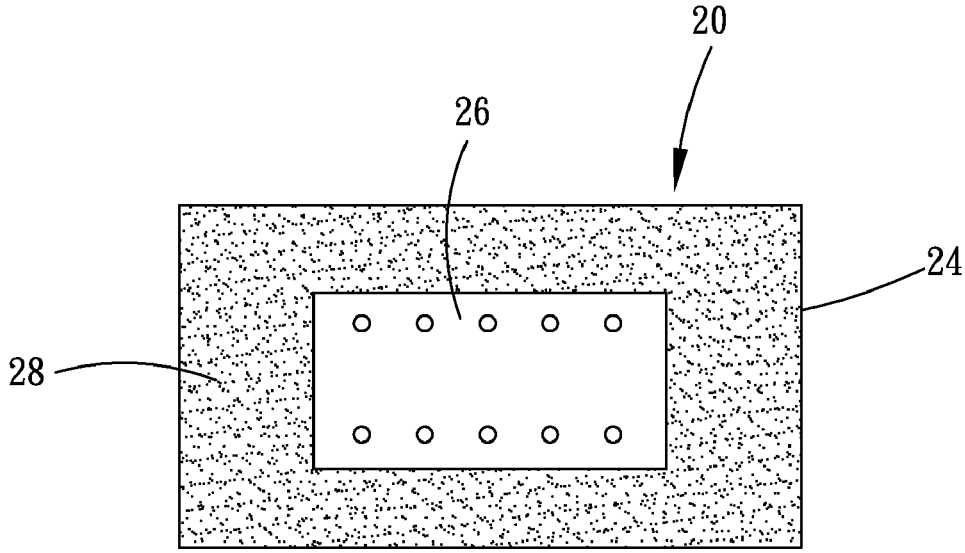
FIG. 5B is another schematic view illustrating the light-transmitting area and its surround area in accordance with the present invention.

Referring to FIGS. 5A and 5B, the light-transmitting area 26 of the light-transmitting element 24 of the light display assembly 20 is the same as or different from its surrounding area 28 in transparence or color.

Figure 6A:
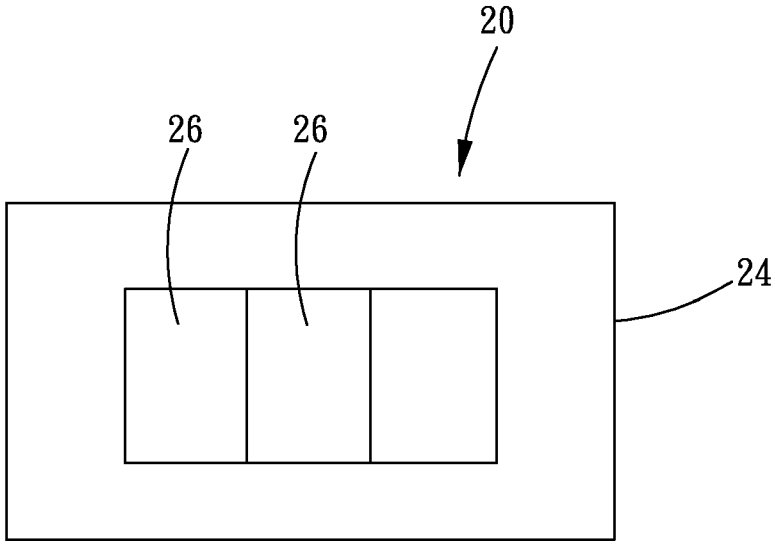
FIG. 6A is a plane view illustrating the light-transmitting area in accordance with the present invention.
Figure 6B:
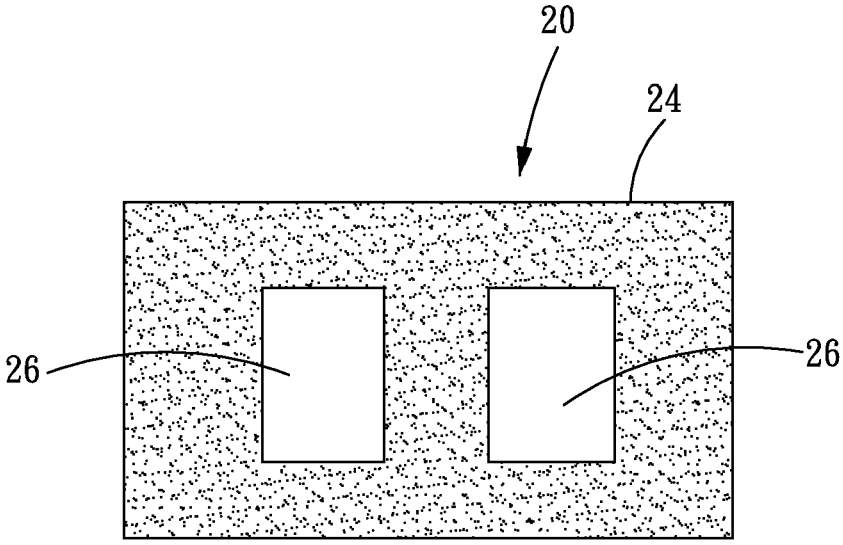
FIG. 6B is another plane view illustrating the light-transmitting area in accordance with the present invention.

Referring to FIG. 6A, the light-transmitting area 26 of the light-transmitting element 24 of the light display assembly 20 is a continuous area. FIG. 6B illustrates that the light-transmitting area 26 of the light-transmitting element 24 of the light display assembly 20 includes plural discontinuous areas. The area of the above light-transmitting area 26 is totally at least 2 square centimeters.

Figure 7:
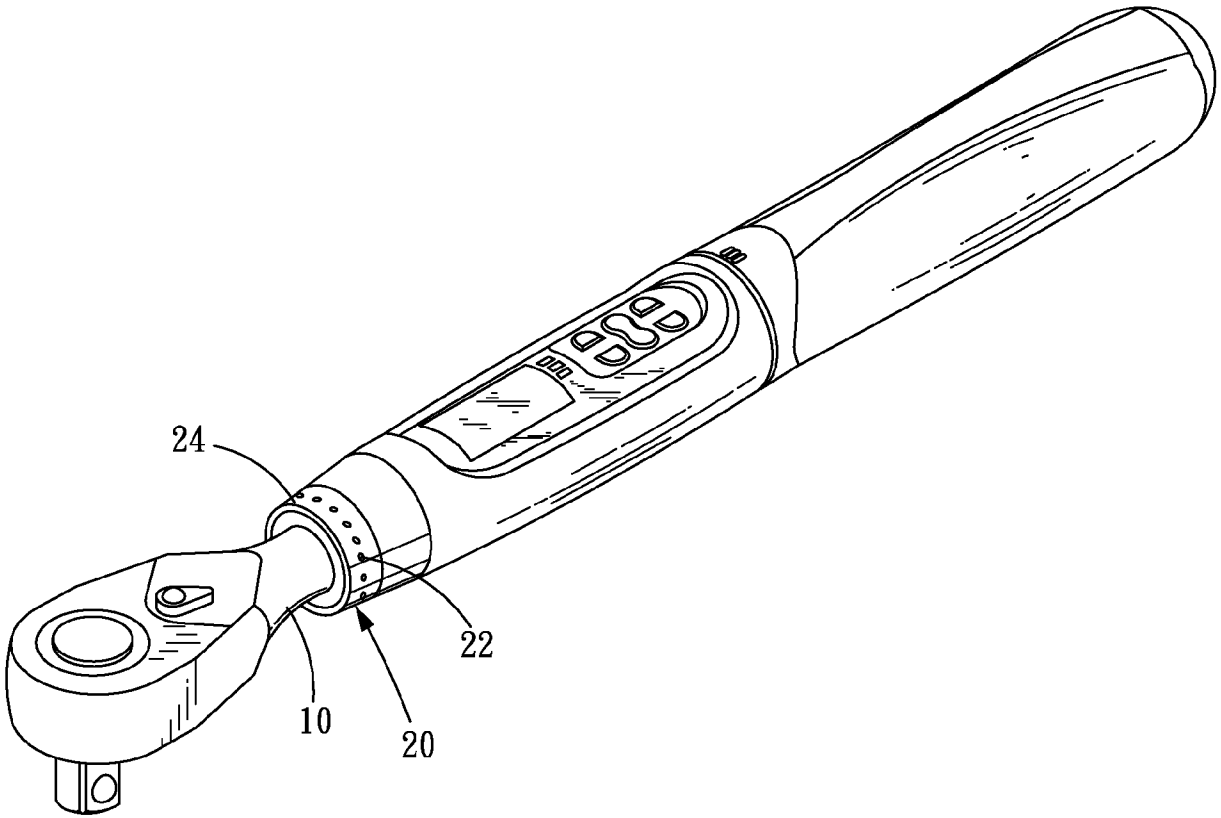
FIG. 7 is a perspective view of the digital tool with a light display in accordance with a sixth embodiment of the present invention.

Referring to FIG. 7, the light-transmitting element 24 of the light display assembly 20 can be formed as an annular element to be mounted on the tool body 10. The light-emitting elements 22 are assembled in the annular light-transmitting element 24.

Figure 8:
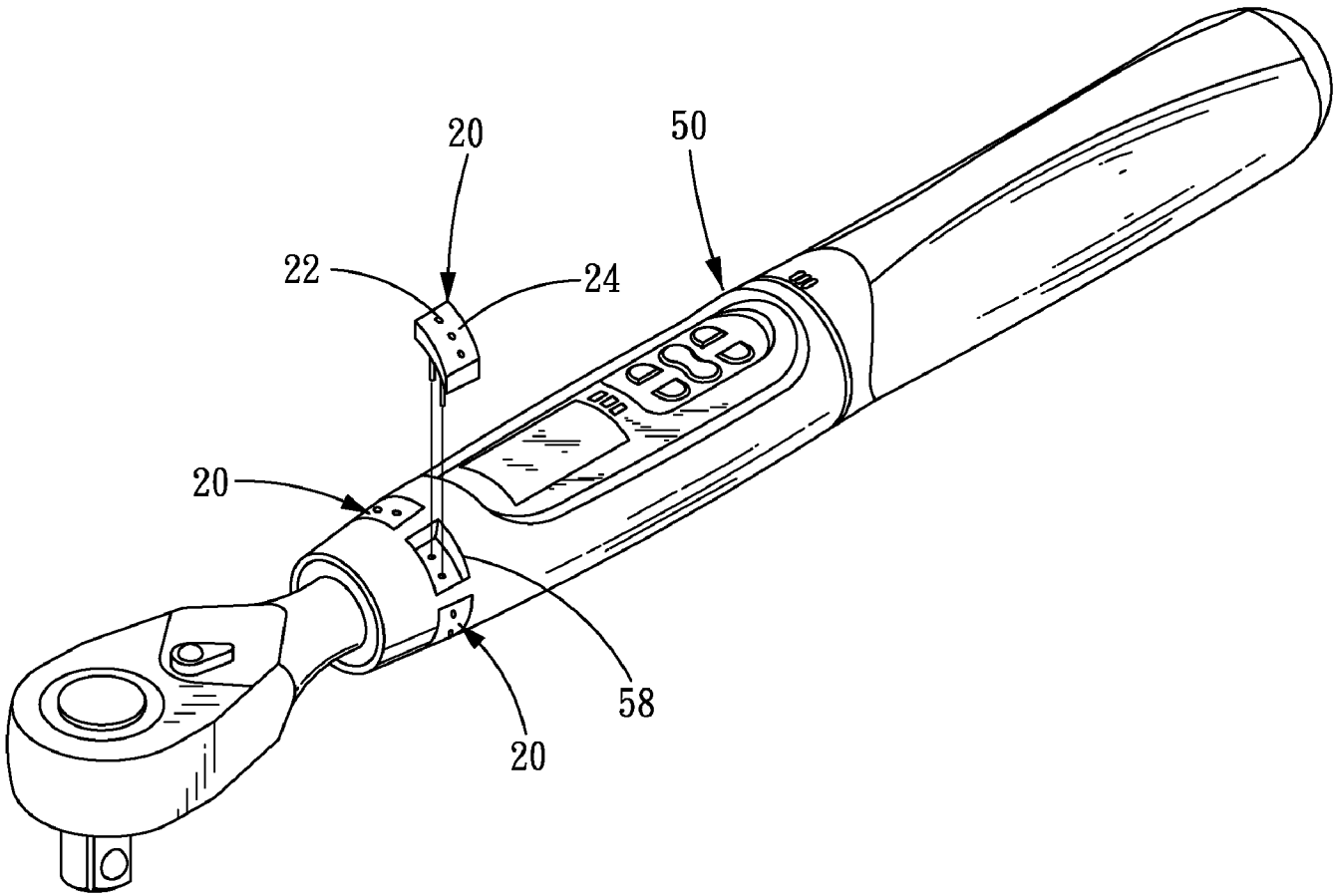
FIG. 8 is a perspective view of the digital tool with a light display in accordance with a seventh embodiment of the present invention.

Referring to FIG. 8, the light-transmitting element 24 of the light display assembly 20 can formed into plural block-shaped parts to be assembled on the digital tool. The light-emitting elements 22 are assembled in the block-shaped parts of the light-transmitting element 24. It is to be noted that the handle sleeve 50 is defined with plural inset holes 58 in an outer surface thereof for insertion of the respective block-shaped parts of the light-transmitting element 24 of the display assemblies 20.

When in use, if the operation torque reaches 80% of the predetermined value, the respective light-emitting elements 22 start to flash intermittently, and if the operation torque achieves 90% or 100% of the predetermined value, the light-emitting elements 22 will be turned on completely to produce stable light or to shine circularly. The above luminous state is only taken as an example but without limitation.

Since the light emitted from the respective light-emitting elements 22 will pass through the light-transmitting element when the operation torque satisfies the predetermined condition, even through working in noisy working environment, the user will also clearly see the light from the tool. In addition, the light-transmitting area of the light-transmitting element provides a large visible area, and the light-transmitting area can be located on any position of the digital tool, so when in use, the user can observe the light from the light-emitting elements 22 easily without considering the operating angle or viewing direction. In addition, because the light display assembly 20 doesn't protrude from the outer surface of the handle sleeve, the light-transmitting element or the light-emitting elements will be prevented from being damaged due to being improperly positioned or colliding with other objects uncontrollably.

While we have shown and described various embodiments in accordance with the present invention, it is clear to those skilled in the art that further embodiments may be made without departing from the scope of the present invention.

What is claimed is:

1. A digital tool with a light display which is used to produce an operation force and has a function of capable of setting or being inherently set with a predetermined condition, comprising:

a tool body with a handle sleeve assembled on an outer surface thereof;

a light display assembly being assembled on the handle sleeve of the tool body and including four light-emitting elements located opposite a light-transmitting area of a light-transmitting element, and the light display assembly being the whole or a part of the handle sleeve; and a display means including a compare unit and a control unit that are electrically connected to the light-emitting elements, the compare unit being used to compare the operation force with the predetermined condition, and the control unit being used being used, under the predetermined condition, to make the respective light-emitting elements emit light through the light-transmitting area synchronously or alternately.

2. The digital tool with a light display as claimed in claim 1, wherein the handle sleeve includes a handle, the light display assembly is the whole or a part of the handle.

3. The digital tool with a light display as claimed in claim 2, wherein the handle of the handle sleeve includes a battery cover, the light display assembly is the battery cover.

4. The digital tool with a light display as claimed in claim 1, wherein the handle sleeve includes a control case, the light display assembly is the whole or a part of the control case.

5. The digital tool with a light display as claimed in claim 1, wherein the light-transmitting area of the light-transmitting element of the light display assembly and its surrounding area have the same transparence.

6. The digital tool with a light display as claimed in claim 1, wherein the light-transmitting area of the light-transmitting element of the light display assembly and its surrounding area have different transparences.

7. The digital tool with a light display as claimed in claim 1, wherein the light-transmitting area of the light-transmitting element of the light display assembly and its surrounding area have the same color.

8. The digital tool with a light display as claimed in claim 1, wherein the light-transmitting area of the light-transmitting element of the light display assembly and its surrounding area have different colors.

9. The digital tool with a light display as claimed in claim 1, wherein the light-transmitting area of the light-transmitting element of the light display assembly is continuous.

10. The digital tool with a light display as claimed in claim 1, wherein the light-transmitting area of the light-transmitting element of the light display assembly is discontinuous.

11. The digital tool with a light display as claimed in claim 1, wherein the light-transmitting area of the light-transmitting element of the light display assembly totally has at least 2 square centimeters.

12. The digital tool with a light display as claimed in claim 1, wherein the light-emitting elements of the light display assembly are light-emitting diodes, and the light-transmitting area of the light-transmitting element of the light display assembly and its surrounding area have the same transparence and color.

13. The digital tool with a light display as claimed in claim 1, wherein the control unit is a programmable unit.

14. The digital tool with a light display as claimed in claim 1, wherein the light-transmitting element of the light display assembly is formed as an annular element to be mounted on the tool body.

15. The digital tool with a light display as claimed in claim 1, wherein the light-transmitting element of the light display assembly is formed into plural block-shaped parts to be assembled on the tool body.

* * * * *